US005560504A

United States Patent [19]

Molinaro

[11] Patent Number: 5,560,504

[45] Date of Patent: Oct. 1, 1996

[54] SNAP ON PULL OFF TAMPER INDICATING FLEXIBLE CAP AND NECK CONFIGURATION

[76] Inventor: Luca Molinaro, 1716 Audley, New Castle, Pa. 16105

[21] Appl. No.: 150,356

[22] Filed: Nov. 4, 1993

Related U.S. Application Data

[63] Continuation-in-part of Ser. No. 36,277, Mar. 24, 1993, abandoned.

[51] Int. Cl.[6] ..... B65D 41/34

[52] U.S. Cl. ..... 215/256; 215/331; 215/224

[58] Field of Search ..... 215/224, 217, 215/318, 250, DIG. 1, 331

[56] References Cited

U.S. PATENT DOCUMENTS

| | | |
|---|---|---|
| 1,443,682 | 1/1923 | Gueritey . |
| 2,162,711 | 6/1939 | Hamberger . |
| 2,162,712 | 6/1939 | Hamberger . |
| 3,504,818 | 4/1970 | Crisci et al. . |
| 3,650,428 | 3/1972 | Miller . |
| 3,980,195 | 9/1976 | Fillmore . |
| 4,298,129 | 11/1981 | Stull . |
| 4,354,609 | 10/1982 | Hidding . |
| 4,402,415 | 9/1983 | Hopley . |
| 4,418,828 | 12/1983 | Wilde et al. . |
| 4,476,987 | 10/1984 | Wilde et al. . |
| 4,497,765 | 2/1985 | Wilde et al. . |
| 4,534,480 | 8/1985 | Santostasi et al. . |
| 4,561,553 | 12/1985 | Crisci . |
| 4,589,561 | 5/1986 | Crisci . |
| 4,625,875 | 12/1986 | Carr et al. . |
| 4,630,761 | 12/1986 | Thomson . |
| 4,834,252 | 5/1989 | Crisci . |
| 4,852,774 | 8/1989 | Crawford . |
| 5,004,114 | 4/1991 | Terbrusch et al. . |
| 5,060,813 | 10/1991 | Gollasch et al. . |

FOREIGN PATENT DOCUMENTS

| | | |
|---|---|---|
| 0118267 | 10/1986 | European Pat. Off. . |
| 2114553 | 8/1983 | United Kingdom . |

*Primary Examiner*—Joseph M. Moy
*Attorney, Agent, or Firm*—Flehr, Hohbach, Test, Albritton & Herbert

[57] ABSTRACT

A novel snap on pull off tamper indicating cap and neck configuration for containers, the cap having a top with an annular depending wall on its peripheral edge and seven circumferentially spaced continuous spiral thread configurations on the inner surface of the annular depending wall. A removable tear skirt with continuous opposing groups of ratchet teeth on its inner surface depends from the outer peripheral edge of an out-turned flange on said annular wall. An inturned continuous annular rib on said annular depending wall engages on and deforms the neck configuration. The tear skirt is joined to the flange with multiple frangible connections from the ratchet teeth, a pull tab on the tear skirt with frangible lines requiring removal of the tab and tear skirt from the cap before the cap can be rotated. The novel construction also enabling lead-in ends of the seven circumferentially spaced thread patterns on the depending wall to immediately engage the neck configuration having registering circumferentially spaced continuous spiral thread configurations on its exterior thereof.

29 Claims, 2 Drawing Sheets

SNAP ON PULL OFF TAMPER INDICATING FLEXIBLE CAP AND NECK CONFIGURATION

This is a continuation in part of Ser. No. 08/036,277, filed Mar. 24, 1993 now abandoned.

BACKGROUND OF THE INVENTION

1. Technical Field

This invention relates to tamper indicating caps and registering conforming container neck finishes on blow molded plastic jugs which are widely used in the dairy industry and others for expendable packaging of dairy products and the like.

2. Description of Prior Art

Prior art devices of this type have relied on a variety of different cap and neck finish configurations. See for example a first group of U.S. Pat. Nos. 3,980,195, 4,354,609, 4,402,415, 4,561,553 and a second group of U.S. Pat. Nos. 2,163,711, 2,162,712, 3,650,428, 4,418,828, 4,497,765, 4,534,480, 3,504,818, a third group of configurations, U.S. Pat. Nos. 1,443,682, 4,852,774, 5,004,114 and U.S. Pat. Nos. 3,980,195, 4,298,129, 4,476,987, 4,589,561.

In the first and second group of the above referred to U.S. patents, they are directed towards individual neck and cap spiral thread configurations and have the common fault of requiring selective testing rotation of the cap on the threaded neck of the container before the single thread portions engage.

The patents in the third group are directed towards selective multiple thread configurations with specific reference now to U.S. Pat. No. 1,443,682, a thread pattern is disclosed having non-overlapping thread elements.

U.S. Pat. No. 4,852,774 is directed towards a container cap having a plurality of short arcuate inner threads adjacent the outer end of the cap.

U.S. Pat. No. 5,004,114 shows only the container with a neck finish having a plurality of inner engaging twist threads.

The final group of patents noted above are as follows.

In U.S. Pat. No. 3,980,195 a tamper proof closure is disclosed having a top portion with a depending annular wall having threads formed therein. A split tamper proof ring is secured to the cap by multiple severable locations on respective projections from the interior of the tamper proof ring.

U.S. Pat. No. 4,298,129 discloses a child proof snap on twist off safety cap and container having a contoured neck portion defining a sealing bead against the container, a plurality of annularly spaced nibs projecting inwardly from said cap.

U.S. Pat. No. 4,476,987 again shows a tamper evident cap having a series of annularly spaced nibs extending inwardly for engagement against the neck of a container onto which it is placed.

U.S. Pat. No. 4,561,553 is directed towards a snap on twist off tamper proof closure for containers that uses a limited thread configuration and an internal annular flange on the depending wall of the cap to engage the neck finish of the container. The annular flange forms a first fastening configuration by engaging a shallow groove within the neck finish.

U.S. Pat. No. 4,589,561 similar to U.S. Patent ending in 553 which again shows an inturned annular flange on the depending wall of the cap that engages a shallow groove in the exterior surface of the neck finish forming a first fastening configuration.

In U.S. Pat. No. 4,770,306 a location of bridges on a tamper blank styled closure can be seen having a tamper indicating band on the closure with a series of annularly spaced nibs positioned on the depending cap wall above the first threaded portion.

Finally, U.S. Pat. No. 5,213,224 is directed to a snap on screw off cap and container neck in which a circular rib is shown depending from the cap top adjacent to a plug forming a seal with the top of the neck finish.

SUMMARY OF THE INVENTION

A push on pull off tamper indicating flexible cap for containers such as blow molded jugs with the appropriate neck configuration takes the form of a cap portion having a top and an annular depending wall on its peripheral edge radially spaced from an annular sealing flange depending from the top of the cap. There are multiple continuous thread patterns on the inner surface of the annular depending wall with an inturned annular flange adjacent the top for deflecting engagement on the neck finish and an out-turned flange on the lower edge of the annular depending wall which has a plurality of frangible integral connections from the wall to continuous ratchet teeth group configurations on a tear skirt. The neck configuration has spaced areas of continuous reverse groups of ratchet teeth configurations for registration with the ratchet teeth groups on the inner surface of the tear skirt. A pull tab attached to the tear skirt adjacent a vertical positioned weakened line requires the tear skirt with its continuous ratchet teeth group configurations and inturned flange to be removed before removal of the remaining screw cap can be achieved.

DESCRIPTION OF THE PREFERRED EMBODIMENTS

Figure 1:
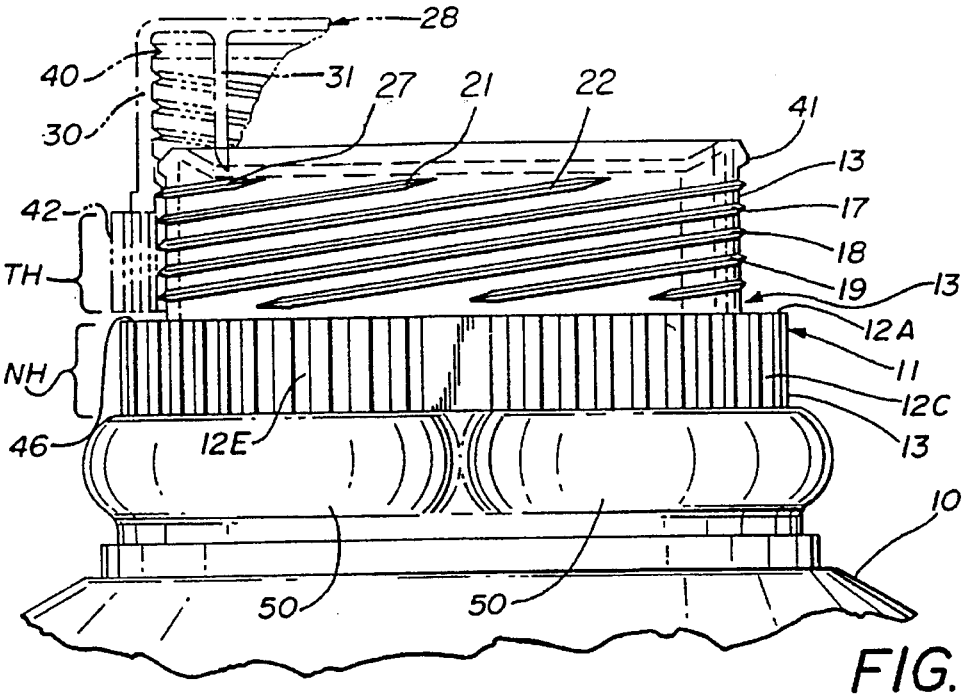
FIG. 1 is a side elevation of the finish on the neck of the blow molded jug with a cap portion partially engaged thereon shown in broken lines.

By referring to the drawings in FIGS. 1–4 in particular it will be seen that a portion of a blow molded jug or the like 10 has a neck 11 of a first diameter including at least four groups of vertically fastening configurations 12 spaced circumferentially thereon which define a shoulder 12A. The neck of the container above the shoulder 12A is a cylindrical portion 13 with a plurality, preferably 7, horizontally and vertically spaced continuous annular threads 14–20 with the upper horizontally spaced ends of the remaining continuous annular spiral threads being indicated by the numerals 21–27.

Figure 2:
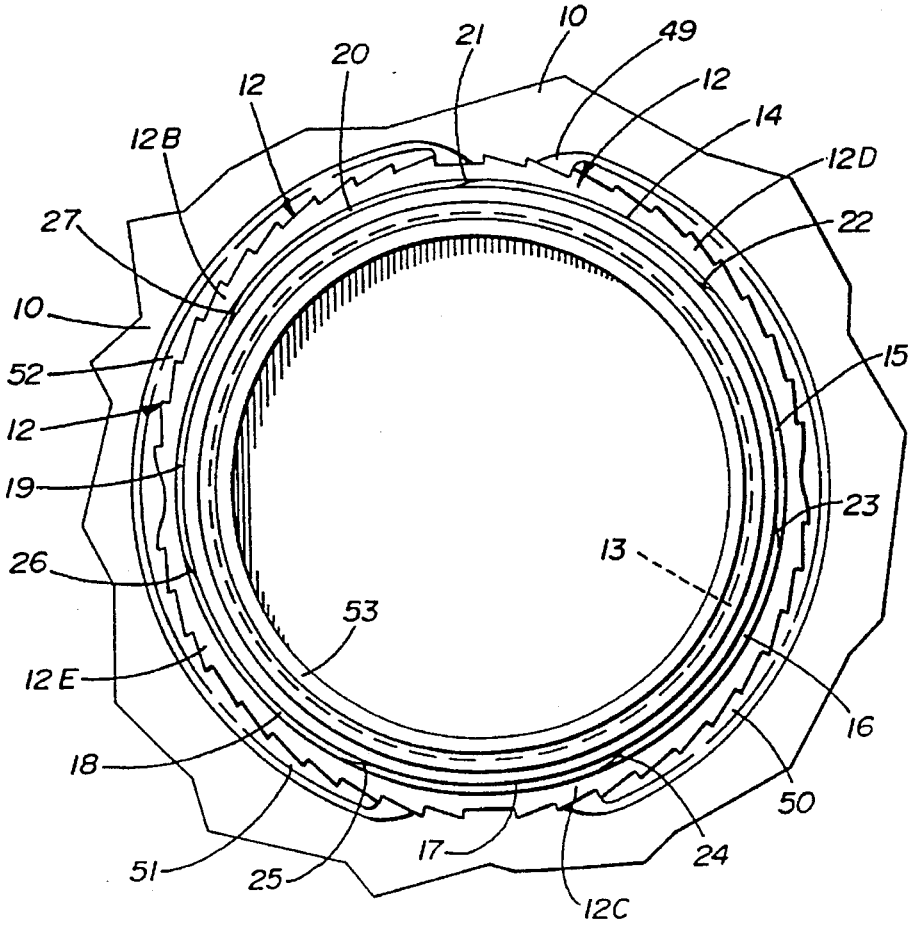
FIG. 2 is a top plan view of the neck finish shown in FIG. 1.

Still referring it FIGS. 1 and 2 of the drawings, it will be seen that each of the vertically and horizontally spaced continuous annular spiral threads 14–20 extend circumferentially around the neck portion before terminating on the cylindrical neck portion 13 in spaced relation to the upper surface of the portion 11 of the neck finish.

It will be seen that the lead in ends 21–27 of the seven circumferentially and vertically spaced continuous annular spiral threads 14–20 respectively and wherein the lead in ends as shown in FIG. 2 of the drawings are spaced circumferentially with respect to one another continuously around the neck finish of the cylindrical neck portion 13.

Additionally in FIG. 2, the vertical fastening configurations 12 may be seen to comprise four groups of ratchet teeth of like pairs which are preferably positioned on the opposing side of the neck portion 13. Opposing like pairs 12B and 12C and 12D and 12E have opposite ratchet teeth direction and group pairs 12D and 12E are of a lesser diameter than said remaining group pairs.

Figure 3:
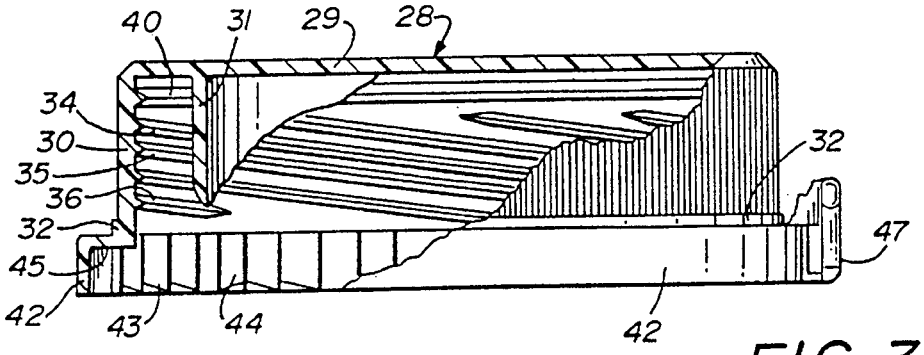
FIG. 3 is a partial cross-sectional view of the push on pull off cap with parts broken away.
Figure 4:
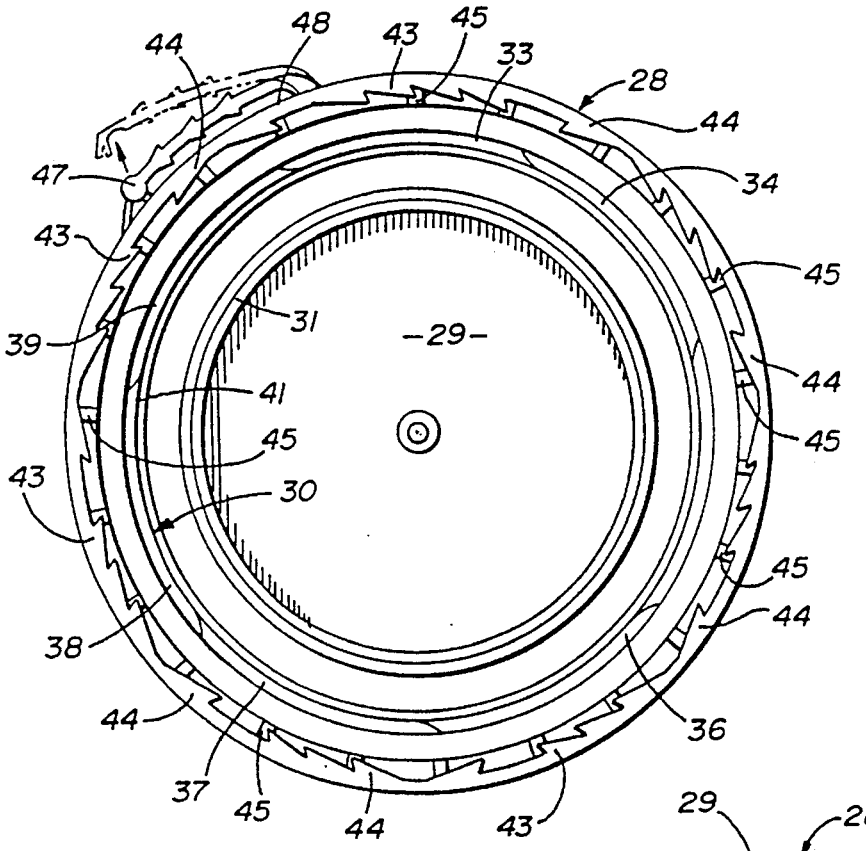
FIG. 4 is a bottom view of the push on pull off flexible cap of the invention illustrating the novel continuous ratchet teeth group configurations on the tear skirt.

Referring to FIGS. 3 and 4, it will be seen that a cap 28 comprises a top portion 29 having an annular depending wall 30 integrally joined to the peripheral edge of the top portion 29. The cap 28 is provided with a downturned annular sealing flange 31 depending from the bottom of the top portion 29, and the bottom edge of the depending annular wall 30 comprises a narrow out-turned rib 32.

The annular depending wall 30 has a plurality of continuous annular spiral cap threads 33–39 and a single inturned annular flange 40 that extend from the inner surface of the depending wall 30 spaced in adjacent relation to the bottom of the top portion 29 and vertically spaced above the respective threads 33–39 as hereinbefore described.

Figure 5:
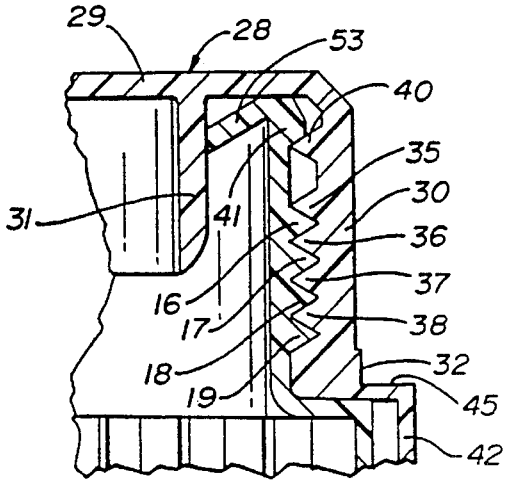
FIG. 5 is a cross-section of a portion of the cap on the neck finish of the invention.

Referring to FIG. 5 of the drawings, a portion of the cap 28 can be seen engaged on a portion of the neck portion 13 of the container 10 in which the respective multiple spiral cap threads 33–39 are in registration with the annular spiral threads 14–20 of the neck finish 13.

The single inturned annular flange or interior bead 40 is in deformable registration under an continuous annular out-turned exterior bead 41 on said neck portion 13 above the respective engaged spiral threads. The annular flange 40 of the cap 28 deforms and contours the respective upper neck portion 13 into a true circular shape by forcing same against the hereinbefore described sealing flange 31 upon placement and sealing of the cap thereon. The rounding off of the uppermost neck portion 13 defines a seal between the cap 28 and the neck finish 11 by sealing same against the sealing flange 31 as well as additional seal between the flange 40 and the neck finish bead 41 as hereinbefore described.

The cap 28 has a tear skirt 42 of a slightly larger diameter than the out-turned rib 32 and is formed with its inner surface having groups of continuous multiple ratchet teeth configuration 43 thereabout with annular spaced reversed ratchet teeth 44 therebetween. A series of connecting members 45 extend from below the out-turned rib 32 to the respective ratchet teeth 43 and 44 by which the tear skirt 42 is integrally attached to the lower peripheral edge of the narrow out-turned rib 32.

It will be apparent that due to the nature of the multiple horizontally and vertically continuous annular spiral spaced threads 14–20 positioned on the neck 11 of the container 10 that the effective initial registration point of the respective cap threads 33–39 will be achieved as the cap is pushed downwardly onto the neck portion 13 in the initial snapping (i.e. sealing of the cap with the neck). As the cap descends vertically onto the neck portion 13, the inner engaging multiple thread portions, hereinbefore described, provide for three distinct "snaps" of engagement. Once the quote "snaps" have been achieved an effective closure seal is achieved between both the annular sealing flange 31 and inturned bead 40 with the neck portion 13.

Since the cap and neck portion 13 are not rotatably pre-positioned before capping, the random position of the initial point of thread engagement will allow due to the multiple thread lead-ins a priority sealing placement of the cap 28 each and every time it is so positioned.

Referring back to FIGS. 1 and 2 of the drawings, it will be seen that the relative height of the cap's tear strip 42 indicated at TH is less than that of the given height of said opposing pairs of vertical fastening configurations 12B and 12E on the neck portion 11 at NH as indicated in FIG. 1 of the drawings. This inconsistency of registering heights between TH and NH defines a vertical space below the bottom of the tear strip 42 at 46 that provides additional visual evidence that the cap has not been tampered with.

The inclusion of spaced ratchet teeth 44 that are in a reversed annular direction to adjacent ratchet teeth 43 groups assure that the cap 29 cannot be effectively rotated on the neck portion 13 in any direction due to the engagement with the vertical fastening configurations 12 which are comprised of the four groups of alternating ratchet teeth 12B–E as hereinbefore described.

This arrangement of reverse registering ratchet teeth requires that the tear strip 42 of the cap 28 be removed first before the cap can be removed by selective rotation.

In order that the tear strip 42 be freed from the remainder of the cap defined by the annular depending wall 30 a pull tab 47 is freed at a vertical tear line 48 when moved outwardly as indicated by the broken lines in FIG. 4 of the drawings. The remaining interconnected portion of the tear skirt 42 is removed completely from the remaining cap portion on the neck 11 by breaking away each of the connecting members 45 which extend from selected ratchet teeth on the tear skirt 42 to the lower edge of the out-turned rib 32 as hereinbefore described. Each of the connecting members 45 is frangible at the lower edge of the out-turned rib 32 so that a relatively clean cap remaining portion defined by the downturned wall 30 is left on the neck portion 13 for typical rotation and selective removal and replacement.

Referring back to FIGS. 1 and 2 of the drawings, it will be seen that the neck 11 has annularly spaced segmented areas of increased arcuate dimension below the vertical fastening configurations 12 that define at least four areas 49,50,51, and 52 thereabout that conform an annular relationship to said hereinbefore described multiple ratchet teeth groups 12B–12E. Additionally, it should be noted that the opposing ratchet teeth groups 12D and 12E are of a lesser arcuate diameter than said adjacent opposing ratchet teeth groups 12B and 12C that as noted are of a reverse annular ratchet teeth direction. This combination of cap and neck ratchet teeth registration along with the registering of the annular inturned flange 40 with the neck bead 41 and an angular inturned neck finish flange 53 defines and imparts a novel improvement to a seven lead in thread cap and neck finish. This provides for a self-aligning multiple sealing non-initial rotational closure that results in an unusual and novel improvement combination for a push on pull off tamper evident cap.

It will thus be seen that an improvement to a push on pull off tamper indicating flexible cap and neck configuration has been illustrated and described and that various changes and modifications may be made therein without departing from the spirit of the invention, therefore I claim:

1. In combination, a container neck and a closure therefor, said neck having an opening, a lip surrounding said opening, an upper neck stretch depending from said lip, an exterior bead on said upper neck stretch, at least one first spiral thread configuration on said upper neck stretch below said exterior bead, a lower neck stretch below said upper neck stretch, and a plurality of first fastening configurations on said lower neck stretch, said closure having a top covering said opening, an upper skirt portion depending from said top, an interior bead on said upper skirt portion, at least one second spiral thread configuration on said upper skirt portion below said interior bead, said at least one second spiral thread configuration slipping past and interengaging said at least one first spiral thread configuration on said upper neck stretch upon direct, axial application of said closure to said neck to retain said closure on said neck until said closure is unscrewed from said neck, an inner skirt spaced inwardly of said upper skirt portion, a removable lower skirt portion below said upper skirt portion, a plurality of second fastening configurations on said lower skirt portion engaging said first fastening configurations on said lower neck stretch, said interior bead on said upper skirt portion engaging said exterior bead on said upper neck stretch when said closure is axially applied to said neck to bring said inner skirt and said neck into sealing engagement.

2. The combination of claim 1 in which said exterior bead extends continuously around the circumference of said upper neck stretch.

3. The combination of claim 1 in which said interior bead extends continuously around the circumference of said upper skirt portion.

4. The combination of claim 1 in which said lip comprises an inwardly extending lip flange.

5. The combination of claim 4 in which said interior and exterior beads bring said inner skirt and said lip flange into sealing engagement.

6. The combination of claim 1 in which said lower neck stretch has a first height and said lower skirt portion has a second height less than said first height so that a portion of said lower neck stretch is exposed beneath said lower skirt portion until said lower skirt portion is separated from said upper skirt portion.

7. The combination of claim 1 in which selected ones of said first fastening configurations and said second fastening configurations are configured to interengage and substantially resist clockwise rotation of said closure relative to said neck, and others of said first fastening configurations and said second fastening configurations are configured to interengage and substantially resist counter-clockwise rotation of said closure relative to said neck.

8. The combination of claim 1 in which said first fastening configurations and said second fastening configurations are ratchet teeth.

9. The combination of claim 1 in which said neck includes a plurality of circumferentially and vertically spaced first spiral thread configurations on said upper neck stretch.

10. The combination of claim 1 in which said closure includes a plurality of circumferentially and vertically spaced second spiral thread configurations on said upper skirt portion.

11. The combination of claim 1 in which said lower skirt portion is frangibly attached to said upper skirt portion by a plurality of circumferentially spaced connecting members.

12. In combination, a container neck and a closure therefor, said neck having an opening, a lip surrounding said opening, an upper neck stretch depending from said lip, an exterior bead on said upper neck stretch, at least one first spiral thread configuration on said upper neck stretch below said exterior bead, a lower neck stretch below said upper neck stretch, a plurality of exterior fastening configurations on said lower neck stretch, said closure having a top, an upper skirt portion depending from said top, an interior bead on said upper skirt portion, at least one second spiral thread configuration on said upper skirt portion below said interior bead, said at least one second spiral thread configuration slipping past and interengaging said at least one first spiral thread configuration on said upper neck stretch upon direct, axial application of said closure to said neck, an inner skirt spaced inwardly of said upper skirt portion, a removable lower skirt portion below said upper skirt portion, and a plurality of interior fastening configurations on said lower skirt portion engaging said exterior fastening configurations on said lower neck stretch, said interior bead on said upper skirt portion engaging said exterior bead on said upper neck stretch when said closure is applied to said neck to bring said inner skirt and said neck into sealing engagement;

at least one of said exterior fastening configurations and at least one of said interior fastening configurations being configured to interengage and substantially resist clockwise rotation of said closure relative to said neck, and at least one of said exterior fastening configurations and at least one of said interior fastening configurations being configured to interengage and substantially resist counter-clockwise rotation of said closure relative to said neck.

13. The combination of claim 12 in which said lip comprises an inwardly extending lip flange.

14. The combination of claim 13 in which said interior and exterior beads interengage when said closure is applied to said neck to bring said inner skirt and said lip flange into sealing engagement.

15. The combination of claim 12 in which said lower neck stretch has a first height and said lower skirt portion has a second height less than said first height so that a portion of said lower neck stretch is exposed beneath said lower skirt portion until said lower skirt portion is separated from said upper skirt portion.

16. The combination of claim 12 in which said exterior fastening configurations each have a leading buttress edge shaped and positioned to engage said interior fastening configurations and substantially resist relative rotation of said closure and said neck and a slanted edge extending inwardly from said buttress edge toward said lower neck stretch, said exterior fastening configurations including at least one first exterior fastening configuration having said buttress edge oriented in a first direction to substantially resist said counter-clockwise rotation and at least one second exterior fastening configuration having said buttress edge oriented in a second direction opposite said first direction to substantially resist said clockwise rotation.

17. The combination of claim 12 in which said interior fastening configurations each have a leading buttress edge shaped and positioned to engage said exterior fastening configurations and substantially resist relative rotation of said closure and said neck and a slanted edge extending outwardly from said buttress edge toward said lower skirt portion, said interior fastening configurations including at least one first interior fastening configuration having said buttress edge oriented in a first direction to substantially resist said counter-clockwise rotation and at least one second interior fastening configuration having said buttress edge oriented in a second direction opposite said first direction to substantially resist said clockwise rotation.

18. The combination of claim 12 in which said exterior fastening configurations and said interior fastening configurations are ratchet teeth.

19. A closure for a container neck of the type having an opening, a lip surrounding said opening, an upper neck stretch depending frown said lip, at least one first spiral thread configuration on said upper neck stretch, a lower neck stretch below said upper neck stretch, and a plurality of first fastening configurations on said lower neck stretch, said closure having a top for covering said opening, an upper skirt portion depending from said top, an interior bead on said upper skirt portion, at least one second spiral thread configuration on said upper skirt portion below said interior bead, said at least one second spiral thread configuration being shaped and positioned to slip past and engage said at least one first spiral thread configuration on said upper neck stretch upon direct, axial application of said closure to said neck to retain said closure on said neck until said closure is unscrewed from said neck, an inner skirt spaced inwardly of said upper skirt portion, a removable lower skirt portion below said upper skirt portion, a plurality of second fastening configurations on said lower skirt portion shaped and positioned to engage said first fastening configurations on said lower neck stretch, said interior bead on said upper skirt portion being shaped and positioned to engage said upper neck stretch between said lip and said first spiral thread configuration when said closure is axially applied to said neck to bring said inner skirt and said neck into sealing engagement.

20. The closure of claim 19 in which said interior bead extends continuously around the circumference of said upper skirt portion.

21. The closure of claim 19 in which said upper skirt portion includes a plurality of circumferentially and vertically spaced second spiral thread configurations.

22. The closure of claim 19 in which said lower skirt portion is frangibly attached to said upper skirt portion by a plurality of circumferentially spaced connecting members.

23. The closure of claim 19 in which selected ones of said second fastening configurations on said lower skirt portion are shaped and positioned to engage selected ones of said first fastening configurations on said lower neck stretch and substantially resist clockwise rotation of said closure relative to said neck, and others of said second fastening configurations are shaped and positioned to engage others of said first fastening configurations to substantially resist counter-clockwise rotation of said closure relative to said neck.

24. A container neck for a closure of the type having a top, an upper skirt portion depending from said top, at least one first spiral thread configuration on said upper skirt portion, an inner skirt spaced inwardly of said upper skirt portion, a removable lower skirt portion below said upper skirt portion, a plurality of first fastening configurations on said lower skirt portion, said neck having an opening, a lip surrounding said opening, an upper neck stretch depending from said lip, an exterior bead on said upper neck stretch, at least one second spiral thread configuration on said upper neck stretch below said exterior bead, said at least one second spiral thread configuration being shaped and positioned to slip past and engage said at least one first spiral thread configuration on said upper skirt portion upon direct, axial application of said closure to said neck to retain said closure on said neck until said closure is unscrewed from said neck, a lower neck stretch below said upper neck stretch, and a plurality of second fastening configurations on said lower neck stretch shaped and positioned to engage said first fastening configurations on said lower skirt portion, said exterior bead on said upper neck stretch being shaped and positioned to engage said upper skirt portion between said top and said first spiral thread configuration when said closure is axially applied to said neck to bring said inner skirt and said neck into sealing engagement.

25. The container neck of claim 24 in which said exterior bead extends continuously around the circumference of said upper neck stretch.

26. The container neck of claim 24 in which said lip comprises an inwardly extending lip flange.

27. The container neck of claim 26 in which said exterior bead is shaped and positioned to bring said inner skirt into sealing engagement with said lip flange when said closure is axially applied to said neck.

28. The container neck of claim 24 in which said neck includes a plurality of circumferentially and vertically spaced first spiral thread configurations on said upper neck stretch.

29. The container neck of claim 24 in which selected ones of said second fastening configurations on said lower neck stretch are shaped and positioned to engage selected ones of said first fastening configurations on said lower skin portion and substantially resist clockwise rotation of said closure relative to said neck, and others of said second fastening configurations are shaped and positioned to engage others of said first fastening configurations to substantially resist counter-clockwise rotation of said closure relative to said neck.

* * * * *